United States Patent [19]
Marsh
[11] 4,106,936
[45] Aug. 15, 1978

[54] MICROIMAGING FILM CONTAINING AN ORGANIC DISELENIDE, A TERTIARY PHOSPHINE OR PHOSPHITE AND AN AZO ORGANIC PEROXIDE AND THE USE THEREOF

[75] Inventor: Dana G. Marsh, Rochester, N.Y.

[73] Assignee: Xerox Corporation, Stamford, Conn.

[21] Appl. No.: 784,109

[22] Filed: Apr. 4, 1977

[51] Int. Cl.[2] ..... G03C 5/04; G03C 5/24; G03C 1/00

[52] U.S. Cl. ..... 96/27 R; 96/27 E; 96/48 QP; 96/48 R; 96/88; 96/119 PQ

[58] Field of Search ..... 96/48 R, 48 QP, 27 R, 96/27 E, 88, 90 R, 119 PQ

[56] References Cited

U.S. PATENT DOCUMENTS

| | | | |
|---|---|---|---|
| 3,544,322 | 12/1970 | Yamada et al. | 96/90 R |
| 3,967,964 | 7/1976 | Marsh et al. | 96/48 R |
| 4,050,937 | 9/1977 | Marsh et al. | 96/48 R |
| 4,050,939 | 9/1977 | Marsh et al. | 96/88 |

*Primary Examiner*—Won H. Louie, Jr.

[57] ABSTRACT

Disclosed is a novel microimaging method suitable for photo-composition. The method involves:

(a) providing a film comprising an organic polymer as matrix material having uniformly dispersed therein:

i. a photochemically reactive organo diselenide characterized by the formula:

$R_1—Se—Se—R_2$ wherein $R_1$ and $R_2$ are aralkyl or alkyl hydrocarbon moieties;

ii. a tertiary phosphine or phosphite characterized by the formula:

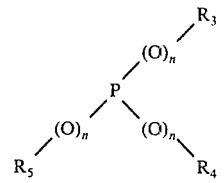

wherein each $n$ is 0 in the case of a phosphine and 1 in the case of a phosphite and $R_3$, $R_4$ and $R_5$ are, independently, substituted or unsubstituted aryl hydrocarbon moieties, and iii. an azo organic peroxide characterized by the formula:

$R_6 — N = N — R_7$ wherein $R_7$ is a peroxycarboxylic acid ester moiety and $R_6$ is either a straight or branched chain alkyl group containing from 4 to 10 carbon atoms or the same as $R_7$;

(b) exposing the film in an imagewise manner to ultraviolet radiation to form an image therein; and (c) heating the exposed film to a temperature of at least about 75°1 C for a time sufficient, depending on the magnitude of the irradiation, to either fix the image or to erase it and prepare the film for reimaging.

26 Claims, No Drawings

MICROIMAGING FILM CONTAINING AN ORGANIC DISELENIDE, A TERTIARY PHOSPHINE OR PHOSPHITE AND AN AZO ORGANIC PEROXIDE AND THE USE THEREOF

BACKGROUND OF THE INVENTION

Microimaging schemes based upon photoreactions of chalcogen compounds, for example, benzyldiselenide, and photoreactions of chalcogen compounds with mercury compounds have been proposed which possess desirable features which render their use advantageous in many situations. However, these imaging systems based upon the photochemistry of chalcogen compounds have the disadvantage of instability in that they are not easily fixed.

It is known that the direct photochemistry of benzyldiselenide (BDS) with ultraviolet light results in the formation of dibenzylselenide (DBS) and selenium. This is shown in equation 1 along with the back reaction:

$$(R\ Se)_2 \underset{}{\overset{h\nu}{\rightleftharpoons}} R_2Se + Se^{\circ} \qquad (1)$$

It is further known that triphenylphosphine (TPP) will react with elemental selenium and with selenium radicals to produce triphenylphosphineselenide, a colorless product. In solution, this leads to increases in the quantum yield for the disappearance of benzyldiselenide presumably via secondary free radical reactions. This reaction occurs as well in solid films and forms a latent image of triphenylphosphineselenide, which if developed, would provide additional contrast above and beyond that obtained by direct photolysis in the absence of this scavenging reagent.

An object of the present invention is to provide an improved process for the manufacture of microimaging film structures.

A further object is to provide a microimaging film with gain.

An additional object is to provide a microimaging film with both high contrast and high resolution.

Another object is to provide a microimaging film that can be imaged and erased repeatedly so as to permit photo-composition of the film.

SUMMARY OF THE INVENTION

The present invention involves a novel imaging method having special applicability for use in microimaging processes. The method comprises:

(a) providing a film of an organic polymer as matrix material having uniformly dispersed therein:

i. a photochemically reactive organo diselenide characterized by the formula:

$$R_1—Se—Se—R_2$$

wherein $R_1$ and $R_2$ are aralkyl or alkyl hydrocarbon moieties;

ii. a tertiary phosphine or phosphite characterized by the formula:

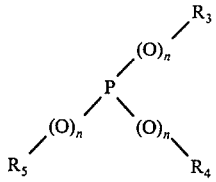

wherein each $n$ is 0 in the case of a phosphine and 1 in the case of a phosphite and $R_3$, $R_4$ and $R_5$ are independently substituted or unsubstituted aryl hydrocarbon moieties; and iii. an azo organic peroxide characterized by the formula:

$$R_6 — N = N — R_7$$

wherein $R_7$ is a peroxycarboxylic acid ester moiety and $R_6$ is either a straight or branched chain alkyl group containing from 4 to 10 carbon atoms or the same as $R_7$;

(b) exposing the film in an imagewise manner to ultraviolet radiation to form an image therein; and (c) heating the exposed film to a temperature of at least about 75° C for a time sufficient, depending on the magnitude of the irradiation, to either fix the image or to erase it and prepare the film for reimaging.

This invention also involves the microimaging film useful in the process.

DETAILED DESCRIPTION AND PREFERRED EMBODIMENTS

This invention is predicated on the discovery that incorporation of suitable loadings of a chalcogen compound, a scavenging compound and an azo organic peroxide in a polymeric binder matrix results in microimaging films which exhibit, upon imagewise exposure to ultraviolet radiation, images exhibiting high contrast and resolution which may be fixed by gentle heating provided sufficient irradiation is employed. The application of lesser amounts of ultraviolet radiation will provide an image which can be erased by gentle heating. In this manner, the film can be imaged and erased repeatedly until the desired image is achieved. Once this photo-composition process is completed, the final image is formed using sufficient ultraviolet radiation to provide a permanent image.

The photochemically reactive diselenides useful in the process of the present invention are selected from those organo diselenides corresponding to the formula:

$$R_1—Se—Se—R_2$$

These compounds are capable of undergoing a decomposition reaction in response to activating radiation and yielding, as one of the products of such decomposition, elemental selenium. Typical of suitable compounds corresponding to the above formula which may be used are those organo diselenides wherein $R_1$ and $R_2$ are independently selected from the group of benzyl, alkyl substituted benzyl, amino substituted benzyl, amido substituted benzyl, arylalkyl substituted benzyl, aryl substituted benzyl, alkoxy alkyl substituted benzyl, amino alkyl substituted benzyl, alkyl amino substituted benzyl, aryl amino substituted benzyl, alkyl carbonyl substituted benzyl, alkyl thio substituted benzyl, alkyl seleno substituted benzyl, carboxamido substituted benzyl, halogen substituted benzyl, carboxy substituted benzyl, cyano substituted benzyl and alkyl alkoxy, amino substituted alkyl, amido substituted alkyl, aryl alkyl, alkoxy alkyl, aryloxy alkyl, hydroxy substituted alkyl, carbonyl substituted alkyl, thio substituted alkyl, seleno substituted alkyl, carboxamido substituted alkyl, halogen substituted alkyl and nitro substituted alkyl; cyclo alkyl and substituted cyclo alkyl.

Many of the compounds within the scope of the above formula are readily available, and those not so available can be prepared by methods disclosed in the technical literature. For example, symmetrical dialkyl selenides can be prepared by the reaction of an alkyl halide with sodium selenide, M. L. Bird et al, J. Chem. Soc. 570 (1942); R. Paetzold et al, L. Amorg. Allg. Chem., 360, 293 (1968). The general method for the preparation of unsymmetrical dialkyl selenides is a modified Williamson synthesis, H. Rheinboldt, "Houben-Weyl Methodender Organischen Chemie", Volume IX, E. Muller, Ed., Georg Thieme Verlag, Stuttgart, pp. 972, 1005, 1020, and 1030 (1955).

Diselenides within the scope of the above formula can be prepared by alkaline hydrolysis of organo selenocyanates as disclosed by H. Bauer in Chem. Ber., 46, 92 (1913). The preparation of unsymmetrical diselenides suitable for use in the invention is accomplished by the reaction of organic selenyl bromides with organic selenols, H. Rheinboldt and E. Giesbrecht, Chem. Ber., 85, 357 (1952). Heterocyclic selenium compounds capable of undergoing substantial carbon-selenium bond scission upon irradiation with ultraviolet light can be prepared by the reaction of organic bromides with organic selenium compounds, L. Chierici et al, Ric. Sci., 25, 2316 (1955).

It should be noted that certain alkyl substituted selenium compounds will be liquids when low molecular weight alkyl substituents are employed. Since solid materials are generally preferred due to ease of film formation, those dialkyl diselenides in which the aggregate number of carbon atoms is at least about 20 will be preferred for film formation.

Those tertiary phosphines useful in the presently disclosed imaging process are characterized by the formula:

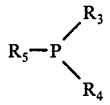

wherein $R_3$, $R_4$ and $R_5$ are independently selected from the group of substituted or unsubstituted aryl hydrocarbon moieties. Typical examples of tertiary phosphines suitable for use in the present invention are triphenylphosphine; tri-paramethoxyphenylphosphine; orthobromophenyldiphenylphosphine; tri-orthotolylphosphine; tri-metatolylphosphine; tris-parafluorophenylphosphine; and para-tolyldiphenylphosphine.

Also useful in the present invention are tertiary phosphites characterized by the formula:

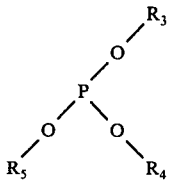

wherein $R_3$, $R_4$ and $R_5$ are as defined above. Exemplary of tertiary phosphites which may be used are triphenylphosphite; and tri-para-tolylphosphite.

The azo organic peroxide is characterized by the formula:

$$R_6 - N = N - R_7$$

wherein $R_7$ is a peroxycarboxylic acid ester moiety and $R_6$ is a straight or branched chain alkyl group containing from 4 to 10 carbon atoms. Esters of this type with the general formula $R_1CO_3R$, sometimes referred to as peroxyesters, are the alkyl esters of peroxycarboxylic acids. The peroxycarboxylic esters are generally prepared by treating alkyl hydroperoxides with an acylating agent, e.g. acid chlorides, anhydrides, ketones, sulfonyl chlorides, phosgene, chloroformates, isocyanates, carbamoyl chlorides, etc. Peroxycarboxylic acid esters for which physical properties have been determined include methyl peroxy-t-butyrate, ethyl peroxy-t-butyrate, trifluoromethyl peroxy-t-butyrate, butenyl peroxy-t-butyrate, n-undecyl peroxy-t-butyrate, l-undecenyl peroxy-t-butyrate, n-dodecyl peroxy-t-butyrate and n-tridecyl peroxy-t-butyrate. Incorportion of the peroxycarboxylic acid ester onto one or both nitrogens of an azo group provides the azo organic peroxide useful in the present invention. When both nitrogen atoms of the azo group have peroxycarboxylic ester moieties bonded to them, an azobis organic peroxide is provided. In this situation $R_1 = R_2$ in the foregoing formula. However, it is not necessary that the azo organic peroxide contain two peroxycarboxylic ester moieties, and $R_1$ may be a straight or branch chain alkyl group of 4 to 10 carbon atoms.

Azo organic peroxides which are particularly useful in the present invention are:

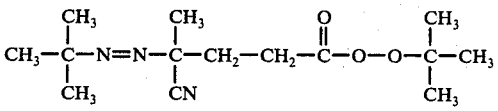

which corresponds to the foregoing general formula in which $R_6$ is t-butyl and $R_7$ is t-butyloxy(4-cyanovalerate);

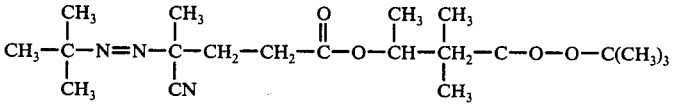

wherein $R_6$ is t-butyl and $R_7$ is 2,2-t-butylperoxy methyl pentyl-4(4-cyanovalerate); and

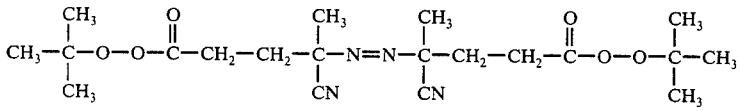

wherein both $R_6$ and $R_7$ are t-butyloxy(4-cyanovalerate).

Other compositions which may be used are those in which $R_7$ and optionally $R_6$ in the azo organic peroxide are t-butylperoxy(4-cyanovalerate), methyl peroxy-4-cyanovalerate, ethyl peroxy-4-cyanovalerate, isopropyl peroxy-4-cyanovalerate, t-butyl peroxy-4-cyanobutyrate, methyl peroxy-4-cyanobutyrate, ethyl peroxy-4-cyanobutyrate, isopropyl peroxy-4-cyanobutyrate, t-butyl peroxy-4-cyanohexanoate, methyl peroxy-4-cyanohexanoate, ethyl peroxy-4-cyanohexanoate and isopropyl peroxy-4-cyanohexanoate.

The polymeric matrix material is comprised of an organic film forming polymer capable of forming a film which is transparent or translucent to the activating radiation used to image the film, i.e. ultraviolet light. The polymer can consist solely of carbon and hydrogen although substituted polymers such as poly(vinylchloride) can be used. Preferred polymers are those which have glass transition temperatures (Tg) greater than about 75° C. This is deemed to be the case because the imaging films are heated to fix the image and those polymers having glass transition temperatures below the heating temperature will tend to soften allowing the image to diffuse, which diffusion results in a decrease in resolution. Exemplary of polymers useful as the matrix polymer are poly(vinylformal), poly(vinylbutyral), poly(vinylalcohol), poly(methylmethacrylate), poly(-vinylpyrrolidone) and poly(vinylidenechloride). Copolymers and block copolymers may also be employed as the matrix material.

Upon selection of the appropriate matrix polymer, organo diselenide, tertiary phosphine or phosphite and azo organic peroxide, the imaging film is prepared by dissolving these constituents in a suitable solvent and applying the so-formed solution to a suitable substrate in a thin layer. Evaporation of the solvent leaves a film which, when exposed to activating radiation and heat, bears a visible image corresponding to the exposed areas. Suitable solvents are those compositions which dissolve the materials and do not detrimentally interact with them. Such solvents include tetrahydrofuran, carbon disulfide, acetone, methyl ethyl ketone and methylene dichloride.

The relative proportions of the matrix polymer, organo diselenide, tertiary phosphine or phosphite and azo organic peroxide are not critical, provided the matrix polymer is the principal ingredient. Typically, the organo diselenide will account for from about 25 to 40 weight percent of the imaging film. The tertiary phosphine or phosphite is preferably employed in an amount of 15 to 25 weight percent of the film with the azo organic peroxide preferably accounting for from 20 to 30 weight percent of the imaging film.

Exemplary of substrates upon which the imaging film may be cast are Mylar, glass, metals and coated papers. If desired, the dried film can be stripped from the substrate either before or after imaging. The thickness of the film is not critical but is generally at least about 1 micron because of fabrication problems with submicron films. Film thicknesses up to about 5 microns or more are satisfactory. The process of forming the film may include roller coating, knife coating, mil coating, brushing, etc. A preferred method is to use a doctor blade as applicator.

Upon casting the film and evaporating the solvent, optionally with gentle heating and/or evacuation under high vacuum to accelerate solvent removal, the composition is ready for imaging which is accomplished by subjecting it to ultraviolet radiation in an imagewise fashion, i.e. irradiating the film in those areas in which the image is desired. This is normally accomplished by placing a stencil or negative having areas which are opaque and transparent to the radiation between the light source and the film and directing the ultraviolet light through this barrier to the film.

After imaging, the films are heated to a temperature of at least about 75° C. The heating step will, depending on the magnitude of the irradiation, either fix the image or erase it. The ability to erase the once formed image causes the films of the present invention to be of particular interest. This is the case because the film can be used in photocomposition techniques wherein all or part of the image can be erased and reimaged until the desired result is achieved.

Once the desired image is obtained, sufficient irradiation is employed to cause it to be fixed rather than erased upon heating. It has been found that exposing the film to less than about 2 J/cm$^2$ will result in an image that can be erased by heating. Exposure to a greater amount of irradiation results in an image which is enhanced upon heating. This threshold level may vary somewhat from film to film, depending on its particular composition, but can be determined for a particular film through the exercise of routine experimentation.

The present invention is further illustrated by the following examples in which all percentages are by weight unless otherwise specified.

EXAMPLE I

A film of poly(methylmethacrylate) containing benzyldiselenide (BDS), triphenylphosphine (TPP) and di-t-butyl-4,4'-azobis(4-cyanoperoxy valerate) is prepared by casting from methylenechloride the following composition [10% PMMA, 5% BDS, 5% TPP and 6.4% di-t-butyl-4,4'-azobis(4-cyanoperoxy valerate) obtained from the Lucidol division of Pennwalt Corporation] onto a Mylar substrate using a Gardner mechanical drive film coating apparatus with a 4 mil gap applicator bar. The coated film is dried overnight to remove the solvent.

The film is exposed to the full output of a high pressure, point source, mercury arc for a period of 5 minutes. After this initial exposure, an image is formed in the film. The imaged film is heated to a temperature within the range of from 75° to 100° C for 5 minutes whereupon the image is totally erased.

At this point, the film is again exposed to the mercury arc lamp but for a period of 15 minutes. Heating the reimaged film to 75° C for 5 minutes enhances the image but does not erase it thereby leading to the conclusion that the longer exposure time provides a permanent image.

EXAMPLE II

Several photo-composition films are made by the procedure outlined in Example I. The films are exposed for varying lengths of time and some are heated. The experimental conditions and observed results are set out in Table I.

TABLE I

| Sample No. | Total Light Energy ($J/cm^{-2}$) | Heating Time (Minutes) | Optical Density (Above Background) at 400 nm | at 500 nm |
|---|---|---|---|---|
| 1 | 1.8 | — | 0.11 | — |
| 2 | 1.8 | 5 at 75° C | Image Disappeared | |
| 3 | 5.13 | — | 0.32 | 0.13 |
| 4 | 5.13 | 5 at 75° C | 0.65 | 0.14 |
| 5* | 5.13 | 5 at 75° C | 0.62 | 0.22 |
| 6 | 7.2 | — | 0.51 | 0.15 |
| 7 | 7.2 | 5 at 75° C | 0.82 | 0.30 |

*Heated before and after imaging

From Table I it can be determined that images prepared using substantial amounts of light energy can be enhanced, in terms of optical density above background, by heating. Conversely, images prepared by the use of small amounts of heat energy can be erased by heating to provide films suitable for reimaging.

What is claimed is:

1. A microimaging method which comprises:

(a) providing a film of an organic polymer as matrix material having uniformly dispersed therein:

i. a photochemically reactive organo diselenide characterized by the formula:

$$R_1—Se—Se—R_2$$

wherein $R_1$ and $R_2$ are aralkyl or alkyl hydrocarbon moieties;

ii. a tertiary phosphine or phosphite characterized by the formula:

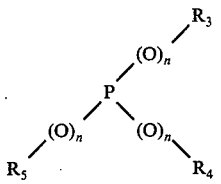

wherein each $n$ is 0 in the case of a phosphine and 1 in the case of a phosphite and $R_3$, $R_4$ and $R_5$ are independently substituted or unsubstituted aryl hydrocarbon moieties; and iii. an azo organic peroxide characterized by the formula:

$$R_6 — N = N — R_7$$

wherein $R_7$ is a peroxycarboxylic acid ester moiety and $R_6$ is either a straight or branched chain alkyl group containing from 4 to 10 carbon atoms or the same as $R_7$;

(b) exposing the film in an imagewise manner to ultraviolet radiation to form an image therein; and (c) heating the exposed film to a temperature of at least 75° C for a time sufficient, depending on the magnitude of the irradiation of step (b), to either fix the image or erase it and prepare the film for reimaging.

2. The method of claim 1 wherein the organo diselenide is characterized by the formula:

$$R_1—Se—Se—R_2$$

and $R_1$ and $R_2$ are aralkyl moieties.

3. The method of claim 1 wherein $R_1$ and $R_2$ are alkyl moieties having an aggregate number of carbon atoms of at least 20.

4. The method of claim 1 wherein the organo diselenide is benzyldiselenide.

5. The method of claim 1 wherein the phosphorous containing element is a tertiary phosphine.

6. The method of claim 5 wherein the tertiary phosphine is triphenylphosphine, tri-paramethoxyphosphine, orthobromophenyldiphenylphosphine, tri-orthotolylphosphine, trimetatolylphosphine, tris-para-fluorophenylphosphine or paratolyldiphenylphosphine.

7. The method of claim 1 wherein the phosphorous containing element is a tertiary phosphite.

8. The method of claim 7 wherein the tertiary phosphite is triphenylphosphite or tri-para-tolylphosphite.

9. The method of the claim 1 wherein the azo organic peroxide is characterized by the formula:

$$R_6 — N = N — R_7$$

wherein $R_6$ is t-butyl and $R_7$ is t-butyloxy(4-cyanovalerate).

10. The method of claim 9 wherein $R_6$ is t-butyl and $R_7$ is 2,2-t-butylperoxy methyl pentyl-4-(4-cyanovalerate).

11. The method of claim 9 wherein $R_6$ and $R_7$ are both t-butyloxy(4-cyanovalerate).

12. The method of claim 1 wherein the matrix polymer is poly(vinylformal), poly(vinylbutyral), poly(-vinylalcohol), poly(methylmethacrylate), poly(vinylpyrolidone) or poly(vinylidenchloride).

13. The method of claim 1 wherein the ultraviolet radiation exposure of the film is less than about $2J/cm^2$ and the image formed is erased upon heating in step (c).

14. The method of claim 1 wherein the ultraviolet radiation exposure of the film is greater than about $2J/cm^2$ and the image formed is fixed upon heating in step (c).

15. A microimaging film which comprises a film of an organic polymer as matrix material having uniformly dispersed therein:

i. a photochemically reactive organo diselenide characterized by the formula:

$$R_1—Se—Se—R_2$$

wherein $R_1$ and $R_2$ are aralkyl or alkyl hydrocarbon moieties;

ii. a tertiary phosphine or phosphite characterized by the formula:

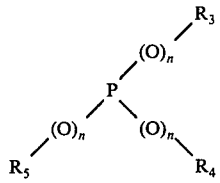

wherein each $n$ is 0 in the case of a phosphine and 1 in the case of a phosphite and $R_3$, $R_4$ and $R_5$ are independently substituted or unsubstituted aryl hydrocarbon moieties; and iii. an azo organic peroxide characterized by the formula:

$$R_6 - N = N - R_7$$

wherein $R_7$ is a peroxycarboxylic acid ester moiety and $R_6$ is either a straight or branched chain alkyl group containing from 4 to 10 carbon atoms or is the same as $R_7$.

16. The film of claim 15 wherein the organo diselenide is characterized by the formula:

$$R_1—Se—Se—R_2$$

and $R_1$ and $R_2$ are aralkyl moietites.

17. The film of claim 15 wherein $R_1$ and $R_2$ are alkyl moieties having an aggregate number of carbon atoms of at least 20.

18. The film of claim 15 wherein the organo diselenide is benzyldiselenide.

19. The film of claim 15 wherein the phosphorous containing element is a tertiary phosphine.

20. The film of claim 19 wherein the tertiary phosphine is triphenylphosphine, tri-paramethoxyphosphine, orthobromophenyldiphenylphosphine, tri-orthotolylphosphine, tri-metatolyphosphine, tris-para-fluorophenylphosphine or paratolydiphenylphosphine.

21. The film of claim 15 wherein the phosphorous containing element is a tertiary phosphite.

22. The film of claim 21 wherein the tertiary phosphite is triphenylphosphite or tri-para-tolyphosphite.

23. The film of claim 15 wherein the azo organic peroxide is characterized by the formula:

$$R_6 - N = N - R_7$$

wherein $R_6$ is t-butyl and $R_7$ is t-butyloxy(4-cyanovalerate).

24. The film of claim 15 wherein $R_6$ is t-butyl and $R_7$ is 2,2-t-butylperoxy methyl pentyl-4-(4-cyanovalerate).

25. The film of claim 23 wherein $R_6$ and $R_7$ are both t-butyloxy(4-cyanovalerate).

26. The film of claim 15 wherein the matrix polymer is poly(vinylformal), poly(vinylbutyral), poly(vinylalcohol), poly(methylmethacrylate), poly(vinylpyrolidone) or poly(vinylidenechloride).

* * * * *